US005215303A

United States Patent [19]

Yamada et al.

[11] Patent Number: 5,215,303

[45] Date of Patent: Jun. 1, 1993

[54] SHEET ALIGNMENT DEVICE FOR A COPYING APPARATUS HAVING AN INTERMEDIATE STANDBY POSITION

[75] Inventors: Yasushi Yamada; Tsuyoshi Mizubata; Masaru Ushio, all of Hachioji, Japan

[73] Assignee: Konica Corporation, Tokyo, Japan

[21] Appl. No.: 724,373

[22] Filed: Jun. 28, 1991

[30] Foreign Application Priority Data

Jul. 6, 1990 [JP] Japan ..... 2-178534

[51] Int. Cl.[5] ..... B65H 9/00

[52] U.S. Cl. ..... 271/240; 271/171

[58] Field of Search ..... 271/171, 240, 248, 221, 271/223

[56] References Cited

U.S. PATENT DOCUMENTS

| | | | |
|---|---|---|---|
| 4,907,792 | 3/1990 | Washiashi et al. | 271/171 |
| 4,908,673 | 3/1990 | Muramatsu | 271/171 |

FOREIGN PATENT DOCUMENTS

| | | | |
|---|---|---|---|
| 237050 | 9/1987 | European Pat. Off. | 271/171 |
| 3836023 | 5/1989 | Fed. Rep. of Germany | 271/240 |
| 47753 | 3/1983 | Japan | 271/171 |
| 128147 | 7/1984 | Japan | 271/240 |
| 143851 | 8/1984 | Japan | 271/171 |
| 190122 | 10/1984 | Japan | 271/171 |
| 212331 | 12/1984 | Japan | 271/171 |
| 48834 | 3/1985 | Japan | 271/171 |
| 55028 | 3/1986 | Japan | 271/171 |
| 46822 | 2/1987 | Japan | 271/171 |
| 215431 | 9/1987 | Japan | 271/171 |
| 258342 | 10/1988 | Japan | 271/240 |
| 104524 | 4/1989 | Japan | 271/171 |
| 104526 | 4/1989 | Japan | 271/171 |
| 117137 | 5/1989 | Japan | 271/171 |
| 231760 | 9/1989 | Japan | 271/240 |
| 267222 | 10/1989 | Japan | 271/171 |
| 275333 | 11/1989 | Japan | 271/171 |
| 38226 | 2/1990 | Japan | 271/171 |
| 81860 | 3/1990 | Japan | 271/171 |
| 95628 | 4/1990 | Japan | 271/171 |
| 100930 | 4/1990 | Japan | 271/171 |
| 127324 | 5/1990 | Japan | 271/171 |
| 138024 | 5/1990 | Japan | 271/171 |
| 204273 | 8/1990 | Japan | 271/171 |
| 239033 | 9/1990 | Japan | 271/171 |
| 2141109 | 12/1984 | United Kingdom | 271/171 |

*Primary Examiner*—Robert P. Olszewski
*Assistant Examiner*—Steven M. Reiss
*Attorney, Agent, or Firm*—Frishauf, Holtz, Goodman & Woodward

[57] ABSTRACT

A sheet alignment device to align the edges of recording sheets stacked on a sheet stacker of a duplex unit in a two-sided copying apparatus, in which a document image has been copied onto the first surface of the recording sheet and the recording sheet is reversed so that another document image can be copied onto the second surface of the recording sheet. The device has an edge pushing member which can be driven in the range from the maximum width to the minimum width of the recording sheets used in the apparatus in order to align the edges of the recording sheets, a driver which moves the edge pushing member in the width direction of the recording sheet, a detector which detects the width of the edge pushing member located in a home position, and a controller which controls the movement of the edge pushing member to the home position being narrower than the maximum size of recording sheet and wider than the minimum size, based on the result of the detection.

9 Claims, 4 Drawing Sheets

SHEET ALIGNMENT DEVICE FOR A COPYING APPARATUS HAVING AN INTERMEDIATE STANDBY POSITION

BACKGROUND OF THE INVENTION

The present invention relates to an improvement in a sheet alignment device for an automatic duplex unit provided in a copying apparatus which copies a document image onto both sides of a recording sheet.

As a device for reversing a document and thereby copying from both sides of the document, there has been known a reversible automatic document feeder (hereinafter referred to as RADF). When such a device is used, a large number of copies can be easily produced. Further, copies produced are in the same sequence as that of the documents, which eliminates the necessity of changing the sequence of produced copies.

Further, when interlocked with a sorter, collating and sorting by page can be automatically conducted and a large number of copies can be accurately put in order.

As a device in which copies are automatically produced on both sides of a recording sheet through a single operation of a button, an automatic duplex unit (hereinafter referred to as an ADU) is known. When this unit is used, information on both sides of a document is copied onto both sides of a recording sheet, which results in reducing the cost of recording sheets and making it possible to file recorded sheets easily. Further, it can be applied in many ways, including collecting materials in a booklet form.

In the case of duplex copying described above, a recording sheet, onto the first side of which a document image has been copied, is reversed and stacked on a stacker, and then another document image is copied onto the second side of the recording sheet.

A sheet alignment device is provided on the width sides of the stacker in order to align the recording sheets.

The sheet alignment device has a home position where the sheet alignment device is set to a width wider than that of the maximum applicable recording sheet size(for example, A3 size).

Just before the copying operation is started, the recording sheet size is determined automatically or manually, and the width of the sheet alignment device is controlled in accordance with the aforementioned recording sheet size. After the recording sheet size has been determined in the manner described above, a pushing member is moved to the corresponding position by a step motor or other drive units.

However, in the case described above, it takes some time to control the width of the sheet alignment device so that the pushing member is moved from the home position (the maximum width) to the position which agrees with the recording sheet size (for example, A4 size) being utilized. For this reason, the start of the copying operation is delayed and the productivity of duplex copying can not be improved.

SUMMARY OF THE INVENTION

It is a primary object of the present invention to provide a sheet alignment device for a copying apparatus which can contribute to an improvement in productivity when duplex copying is conducted.

The present invention is to provide a sheet alignment device which aligns the edges of recording sheets with regard to the width direction, wherein a document image has been copied onto the first surface of the recording sheet and the recording sheet is reversed so that another document image can be copied onto the second surface of the recording sheet, and which comprises: an edge pushing member which can be moved in the range from the maximum width of the recording sheet used in the copying apparatus to the minimum width in order to push the edges of the recording sheets; a drive means which moves the edge pushing member in the direction of the recording sheet; a width detection means which detects the edge pushing member located in a waiting position; and a control means which controls the waiting position of the edge pushing member according to the result of the detection so that the width of the waiting position can be made narrower than the maximum width of recording sheet, and can be made wider than the minimum width.

In the sheet alignment device of the present invention, the pushing member is held in a predetermined waiting position by the control means. The aforementioned waiting position is defined as a position where the width which is set in the sheet alignment device is more narrow than the maximum width of recording sheet and wider than the minimum width. It is possible to set the waiting position to the middle position of the maximum and minimum width, or it is also possible to set the waiting position to a position corresponding to the recording sheet width which is most frequently used. Therefore, in a normal case, the travel time of the pushing member which is moved from one size position of a recording sheet to another size position, can be shortened.

DESCRIPTION OF THE PREFERRED EMBODIMENT

Figure 1:
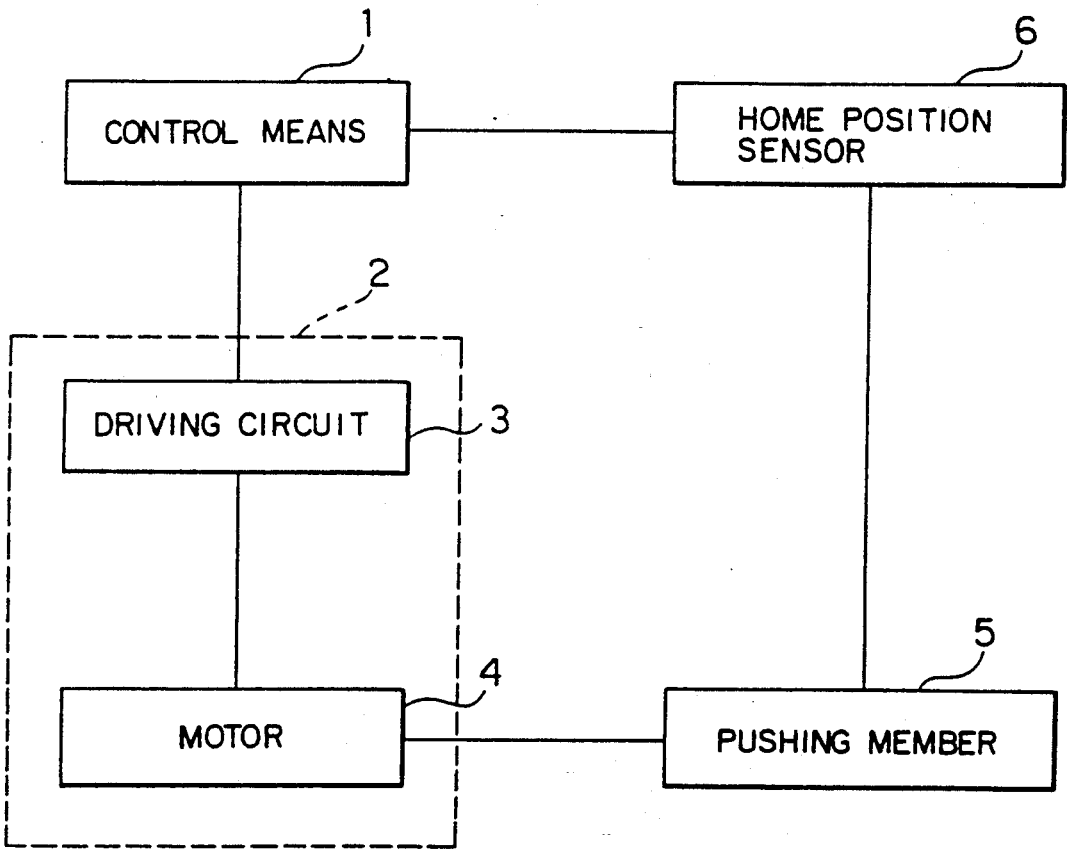
FIG. 1 is a block diagram showing an electrical structure of the copying apparatus of an embodiment of the present invention.

Referring now to the drawings, an embodiment of the present invention will be explained in detail as follows.

First of all, referring to FIG. 2, an outline of the operation of a copying apparatus to which the present invention is applied, will be explained.

Figure 2:
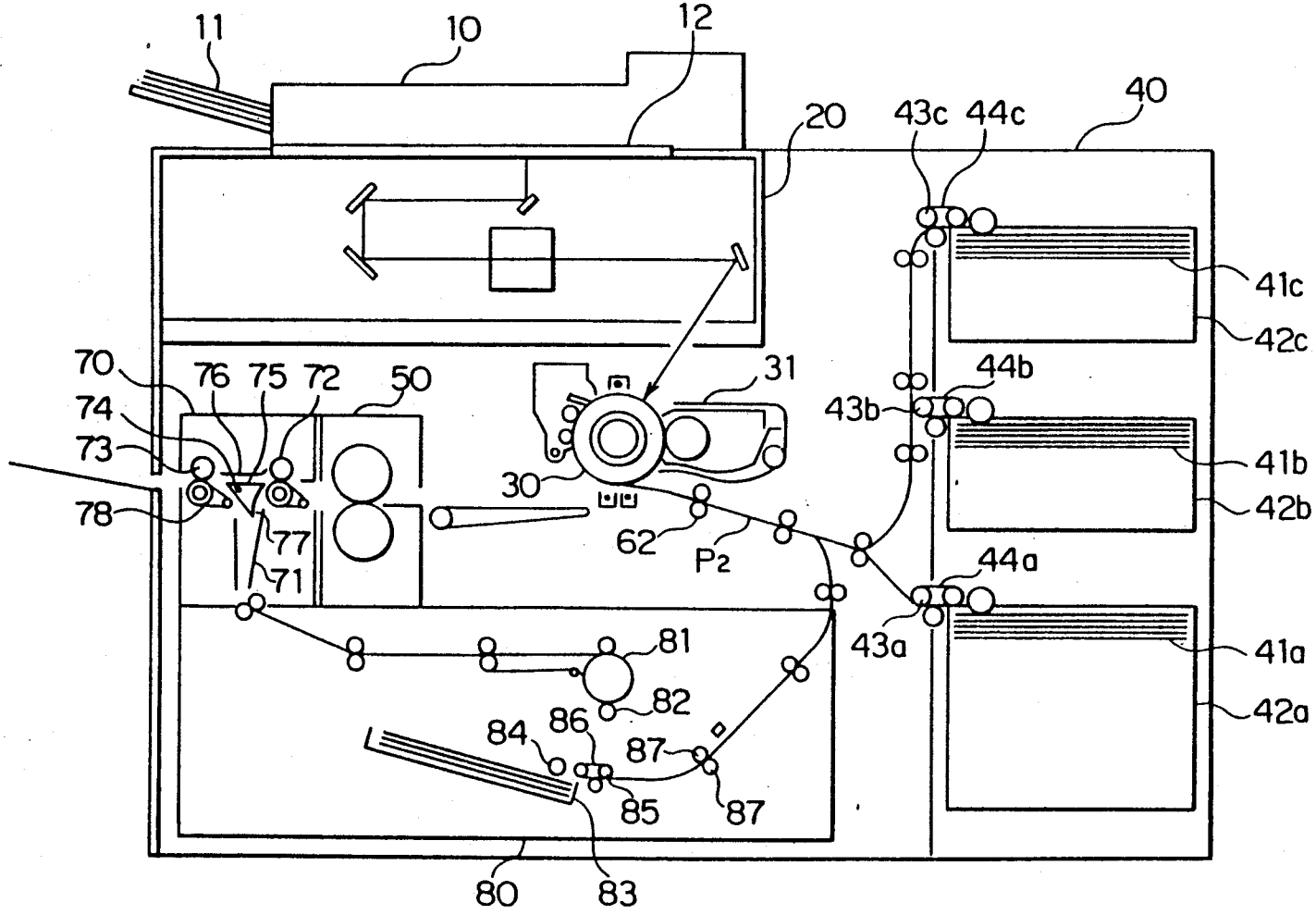
FIG. 2 is a schematic illustration showing the mechanical structure of a copying apparatus to which the embodiment shown in FIG. 1 is applied.

In FIG. 2, a document 11 placed on RADF 10 is conveyed onto a platen glass 12 by the RADF 10 when a copying operation has been started. The document 11 placed on the platen glass 12 is exposed by an optical exposure scanning system 20, and a latent image corresponding to the document 11 is formed on the surface of a photoreceptor 30. The aforementioned latent image is changed into a toner image on the surface of the photoreceptor 30 by a photoreceptor image forming section 31. The toner image is transferred onto a recording sheet 41 supplied from a paper feeding section 40 which will be described later, and the transferred toner image is thermally fixed by a fixing unit 50. The recording sheet, on the first surface of which the document image has been copied, is guided to an ADU 80 by a sheet ejection switching section 70. The recording sheet is stacked on a stacker 83 while it is being reversed by the aforementioned ADU 80. A toner image is formed on the second surface of the recording sheet which has been conveyed to the photoreceptor 30 again. After this toner image has been fixed by the fixing unit 50, the recording sheet is discharged to the outside of the apparatus by the sheet ejection switching section 70.

Figure 3:
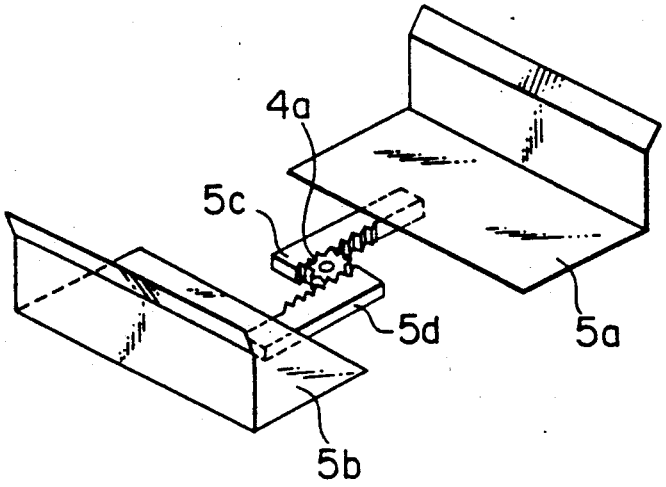
FIG. 3 is a schematic illustration showing the operation of a sheet alignment device.
Figure 4:
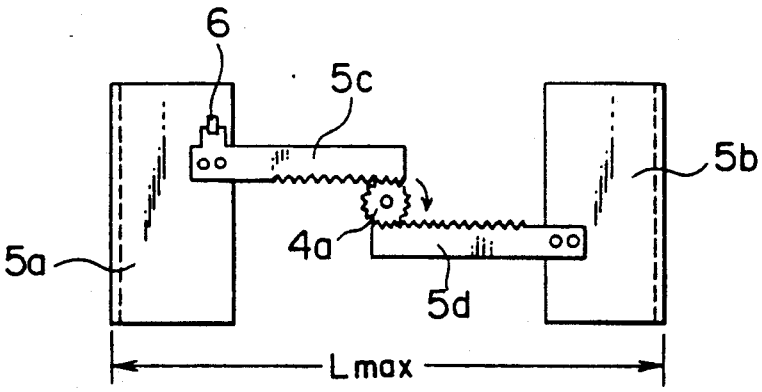
FIG. 4 is a schematic illustration to explain the operation of the sheet alignment device.
Figure 5:
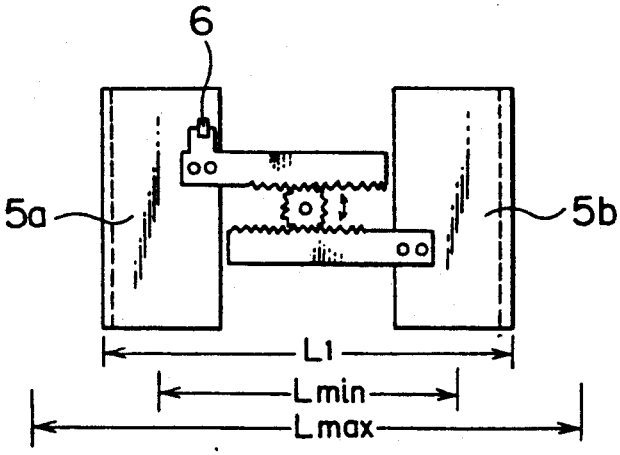
FIG. 5 is a schematic illustration to further explain the operation of the sheet alignment device.

Next, referring to FIG. 1 showing the electrical structure of the embodiment of the present invention, and referring to FIGS. 3, 4, 5 showing the mechanical structure, the structure of the embodiment of the invention will be explained in detail.

Width regulating plates 5*a*, 5*b* comprising a pushing member 5 are made in such a manner that they can be respectively moved by drive members 5*c*, 5*d* in the width direction of the reversed recording sheet. The drive members 5*c*, 5*d* are driven by a gear 4*a* which is rotated by a motor.

As shown in FIG. 4 and FIG. 5 which show the bottom of the pushing member 5, the drive member 5*c* is provided with a home position sensor 6 which can magnetically or optically detect a position. This home position sensor 6 is provided in such a manner that a detection member disposed in a predetermined position can be detected by the home position sensor 6.

For example, suppose that the maximum width Lmax is a little wider than the width of an A3-size, and the minimum width Lmin is the same as the width of a B6-size. In this case, the width corresponding to the position to which the home position sensor 6 is set, and the waiting width of the pushing member 5 (which is the width set to the pushing member when the pushing member is in a waiting state), is set to the width (for example, an A4-size) of a recording sheet which is most frequently used. The width is usually 297 mm or 210 mm in the range of ±30 mm.

Figure 6:
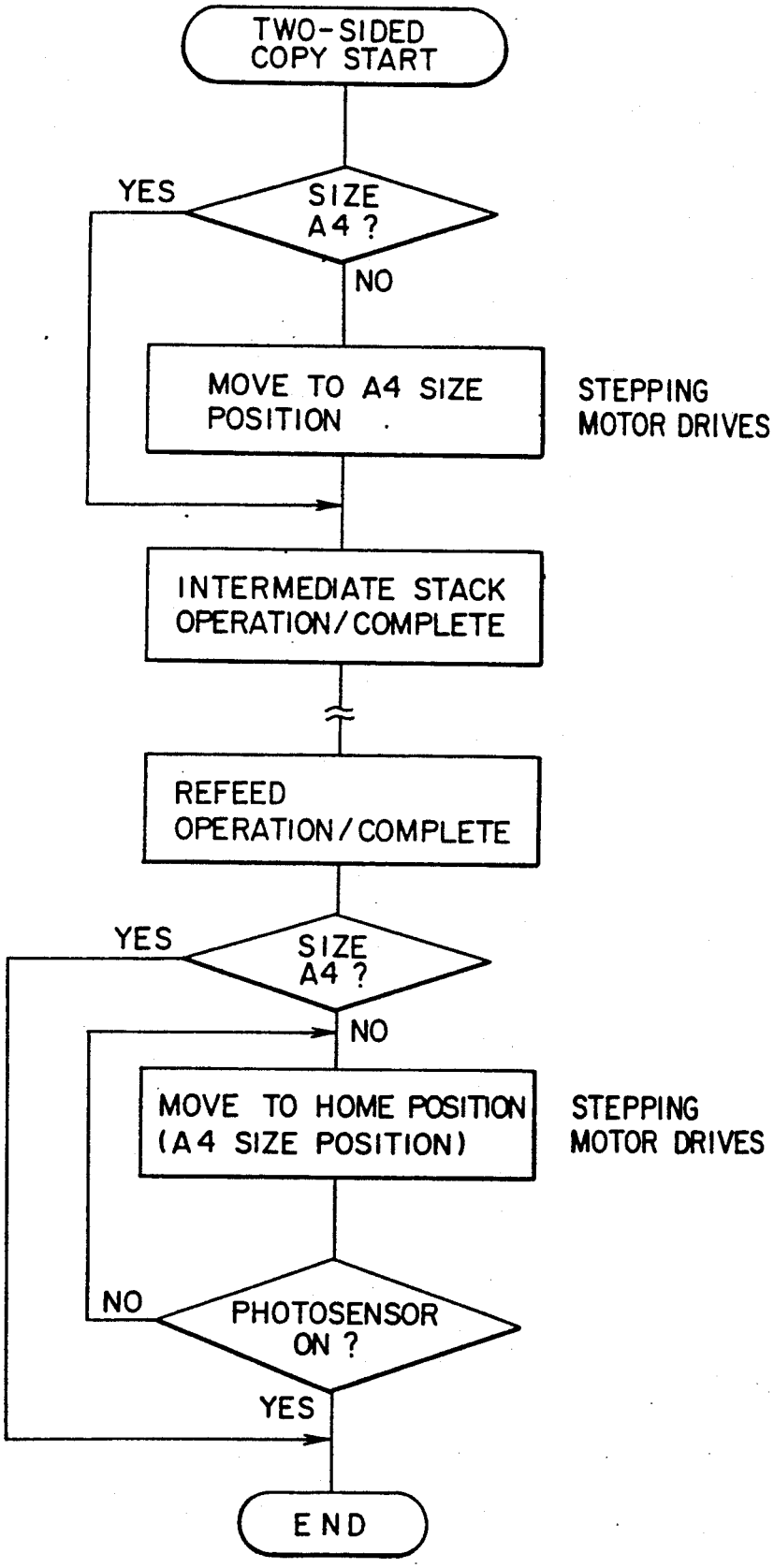
FIG. 6 is a flow chart of the embodiment which shows the flow of the operation of a width regulating plate in the case here the home position of the width regulating plate is set to an A4-size.

In the initial stage when the power switch of the copying apparatus is turned on, or when the successive copying operation starts after the previous copying operation has been completed, a motor 4 is driven through a drive circuit 3 by the control means 1 so that the edge pushing member can be stopped in the position where the home position sensor 6 has detected a recording sheet. In the manner described above, when the apparatus is in a waiting condition, the width regulating plate 5 is set so that the width can be the same as that of the most frequently used recording sheet. As shown in the operation flow of FIG. 6, the waiting position is set to the width of an A4-size and duplex copying of an A4-size is conducted. In the aforementioned case, the width control of the sheet alignment device is not necessary. Therefore, the interval between the direction to start a copying operation and the actual start can be shortened, so that productivity can be improved. The time necessary to move the width regulating plate can be also shortened. However, the time necessary to move the width regulating plate from the waiting position to the position corresponding to the maximum size, becomes longer than the conventional case. However, the method of the present invention can save time as on the whole.

In the case in which not only A4-size papers are frequently used, but B5-size papers are also frequently used, it is possible to dispose the recording sheets in such a manner that the waiting position of the width regulating plate is set halfway between A4-size and B5-size.

Further, it is also possible to compose the control means 1 in such a manner that: the most appropriate waiting position is determined according to the number of frequently-used recording sheets so that the time necessary for moving can be reduced.

Furthermore, it is possible to adopt the following method, wherein the frequency of use of recording sheets is counted and stored in a memory (not shown in the drawing):

(a) The waiting position is set to the position between the most frequently used width (in this case, an A4-size) and the next frequently used width (in this case, a B5-size).

(b) The waiting position is set to the position between the secondmost frequently used width (a B5-size) and the thirdmost frequently used width (a B4-size).

It is also possible to adopt the following serial method, wherein when A4-size recording sheets are used in the (N)th copying operation, and when B5-size recording sheets are used in the (N−1)th operation, the waiting position of (N+1)th is set halfway between an A4-size and a B5-size.

When the apparatus is provided one of the aforementioned learning functions, the waiting position is set to the most appropriate width successively. Therefore, the productivity of duplex copying can be improved.

As explained above, the present invention is to provide a sheet alignment device which aligns the edges of recording sheets with regard to the width direction, wherein a document image has been copied onto the first surface of the recording sheet and the recording sheet is reversed so that another document image can be copied onto the second surface of the recording sheet, and which comprises: an edge pushing member which can be moved in the range from the maximum width of the recording sheet used in the copying apparatus to the minimum width in order to push the edge of the recording sheets; a drive means which moves the edge pushing member in the direction of the recording sheet width; a width detection means which detects the width of the edge pushing member located in a waiting position; and a control means which controls the waiting position of the edge pushing member according to the result of the detection so that the width of the waiting position can be made narrower than the maximum width of the recording sheet, and can be made wider than the minimum width.

Accordingly, the pushing member is held by the control means at a predetermined waiting position. The aforementioned waiting position is narrower than the maximum width of recording sheet and wider than the minimum width. Therefore, in a normal case, the time to move the pushing member when the recording sheet is changed, can be reduced.

Consequently, it is possible to realize a sheet alignment device for a copying apparatus which can contribute to improving productivity when duplex copying is conducted.

What is claimed is:

1. A sheet alignment device for aligning edges of recording sheets stacked on a sheet stacker of a duplex unit in a two-sided copying apparatus, comprising:

(a) edge pushing means for aligning the edges of the recording sheets, said edge pushing means being movable in a range from a maximum width of recording sheets to a minimum width of recording sheets;

(b) drive means for moving said edge pushing means between an alignment position that varies according to the width of a given recording sheet and a waiting position that corresponds to a width that is narrower than the maximum recording sheet width and wider than the minimum recording sheet width;

(c) detection means for detecting that said edge pushing means is in a home position and for outputting a detection signal when said edge pushing means is in said home position; and (d) control means for controlling said drive means to move said edge pushing means, said control means being responsive to said detection signal outputted by said detection means for causing said drive means to stop movement of said edge pushing means at said waiting position.

2. The sheet alignment device of claim 1, wherein said waiting position corresponds to a recording sheet width halfway between the maximum and minimum recording sheet width.

3. The sheet alignment device of claim 1, wherein said waiting position corresponds to a recording sheet width which is most frequently used.

4. The sheet alignment device of claim 1 further comprising a memory to store a frequency of use of given recording sheet widths, and wherein said waiting position corresponds to a recording sheet width determined in accordance with the stored frequency of use.

5. The sheet alignment device of claim 4, wherein said waiting position corresponds to a width halfway between a most frequently used recording sheet width and a next most frequently used recording sheet width.

6. The sheet alignment device of claim 4, wherein said waiting position corresponds to a width halfway between a width of a last aligned recording sheet and a width of a next to last aligned recording sheet.

7. The sheet alignment device of claim 1, wherein after a previous copying operation has been completed and before a successive copying operation begins, said control means controls said drive means to move said edge pushing means to said waiting position.

8. The sheet alignment device of claim 1, wherein said home position corresponds to said waiting position.

9. The sheet alignment device of claim 1, wherein when a power switch of said copying apparatus is turned on, said control means controls said drive means to move said edge pushing means to said waiting position.

* * * * *